US006639560B1

(12) United States Patent
Kadambi et al.

(10) Patent No.: US 6,639,560 B1
(45) Date of Patent: Oct. 28, 2003

(54) SINGLE FEED TRI-BAND PIFA WITH PARASITIC ELEMENT

(75) Inventors: Govind R. Kadambi, Lincoln, NE (US); Jon L. Sullivan, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/135,312

(22) Filed: Apr. 29, 2002

(51) Int. Cl.[7] ..... H01Q 1/24; H01Q 1/38
(52) U.S. Cl. ..... 343/700 MS; 343/702
(58) Field of Search ..... 343/700 MS, 702, 343/895, 846, 712, 848

(56) References Cited

U.S. PATENT DOCUMENTS 6,040,803 A * 3/2000 Spall ..... 343/700 MS
6,348,892 B1 * 2/2002 Annamaa et al. .... 343/700 MS
6,456,249 B1 * 9/2002 Johnson et al. ..... 343/702
6,466,170 B2 * 10/2002 Zhou ..... 343/700 MS

* cited by examiner

*Primary Examiner*—James Clinger
(74) *Attorney, Agent, or Firm*—Holland & Hart LLP

(57) ABSTRACT

A Planar Inverted F-Antenna (PIFA) comprising: a radiating element placed above a dielectric carriage with four side walls; a ground plane positioned below the dielectric carriage; a short circuiting element at the front edge of the radiating element; a feed tab at the front edge of the radiating element; vertical planes formed along the right and left edges of the radiating element forming capacitive loading plates; a first reactive loading slot formed in the radiating element between the short circuiting element and the left edge thereof; the open end of the first reactive loading slot being at the front edge of the radiating element; a second reactive loading slot formed in the radiating element between the feed tab and the right edge thereof; the open end of the second reactive loading slot being at the back edge of the radiating element; conductive stubs at the front and back edges of the radiating element for tuning lower and upper resonant frequencies; a conductive strip having a vertical attachment inserted into the dielectric carriage through a slot in the back side wall of dielectric carriage; the conductive strip with its vertical attachment being positioned flush with the outer surface of the back side wall and is connected to the ground plane to serve as a parasitic element to the radiating element for an additional and exclusive resonance.

35 Claims, 11 Drawing Sheets

SINGLE FEED TRI-BAND PIFA WITH PARASITIC ELEMENT

BACKGROUND OF THE INVENTION

1. Field of the Invention

The present invention relates to a Planar Inverted F-Antenna (PIFA) and, in particular, to a single feed PIFA having an internal parasitic element for tri-band operation including the dual cellular and non-cellular frequency bands.

2. Description of the Related Art

Cellular communication technology has witnessed a rapid progress in the recent past. Of late, there is an enhanced thrust for internal cellular antennas to harness their inherent advantages. The concept of an internal antenna stems from the avoidance of protruding external radiating element by the integration of the antenna into the device itself. Internal antennas have several advantageous features over external antennas such as being less prone to external damage, a reduction in overall size of the handset with optimization, and easy portability. The printed circuit board of the communication device serves as the ground plane of the internal antenna. Among the various choices for internal antennas, PIFA appears to have great promise. The PIFA is characterized by many distinguishing properties such as relative lightweight, ease of adaptation and integration into the device chassis, moderate range of bandwidth, Omni directional radiation patterns in orthogonal principal planes for vertical polarization, versatility for optimization, and multiple potential approaches for size reduction. The PIFA also finds useful applications in diversity schemes. The sensitivity of the PIFA to both vertical and horizontal polarization is of immense practical importance in mobile cellular/RF data communication applications because of the absence of fixed orientation of the antenna as well as the multi path propagation conditions. All these features render the PIFA to be a good choice as an internal antenna for mobile cellular/RF data communication applications.

In the rapidly evolving cellular communication technology and ever increasing demand for multi-systems applications, there is a growing trend towards the design of a multi-purpose cellular handset. A cellular handset with system capabilities of both the dual cellular and non-cellular (such as GPS or Bluetooth [BT]) applications has become a new feature. Therefore, there is an enhanced interest for the design of a single feed cellular antenna which operates in both the dual cellular and non-cellular frequency bands. The inherent problem facing such a design is the bandwidth requirement of the upper resonant band of the antenna to simultaneously cover upper cellular (DCS or PCS) and the non-cellular (GPS or BT) frequencies. In most of the research publications/patents on PIFA technology, the major success has been the design of a single feed PIFA with dual resonant frequencies resulting essentially in a dual band PIFA. Depending upon the achievable bandwidth around the two resonant frequencies, the dual resonant PIFA can potentially cover more than 2 bands. However, system applications like GPS and BT or IEEE 802.11 have frequency bands that are significantly off from the dual cellular bands (AMPS/GSM, DCS/PCS). The extension of the currently available cellular dual band PIFA designs to additionally cover the GPS or BT (ISM) band imposes rather non-realizable bandwidths centered around the dual resonant cellular frequencies. For example, to extend the operation of a cellular dual band (AMPS/PCS) PIFA to cover the GPS band would imply the bandwidth requirement of 23.35% for the upper resonance combining GPS and PCS bands (1575 to 1990 MHz). The corresponding bandwidth requirement of the (GSM/DCS/GPS) PIFA for its upper resonance combining GPS and DCS bands (1575 to 1880 MHz) is 17.72%. Likewise, to extend the operation of the cellular dual band (AMPS/PCS) PIFA to cover the BT/ISM application would require 29.89% bandwidth for its upper resonance comprising both PCS and ISM bands (1850 to 2500 MHz). It is very difficult to achieve such a wide bandwidth out of the currently reported PIFA designs. A dual feed multi-band PIFA with separate feeds exclusively for dual cellular bands and non-cellular band has not proved to be an attractive choice because of the mutual coupling between the individual feeds. Therefore the design technique of a multi-band (dual cellular and non-cellular) PIFA devoid of the problem of mutual coupling is called for. The design scheme of a single feed PIFA, which can effectively overcome the enormity of bandwidth requirement centered around any specific resonant frequency to simultaneously cover dual cellular and non-cellular bands, will be of significant practical importance from a system point of view. It is also desirable that the alternative design techniques of a single feed PIFA for the simultaneous inclusion of the dual cellular and non-cellular resonant bands should not involve an increase in the overall volume of the antenna.

The instant invention proposes a new technique for designing a single feed tri-band (dual cellular and non-cellular) PIFA which overcomes the enormity of the bandwidth requirement for its upper resonant band covering both upper cellular and non-cellular frequencies. The serious problem of the mutual coupling encountered in the dual feed multi-band PIFA is a non-entity in the proposed design scheme of this invention. A possible practical recourse to design a single feed tri-band PIFA that covers the cellular and non-cellular systems applications lies in the realization of three distinct resonant frequencies at the respective bands and to achieve the requisite bandwidths centered around the resonant frequencies of interest. This invention proposes the placement of a shorted parasitic element internal to the dual cellular band PIFA structure to realize a third and an exclusive non-cellular resonant frequency band of the PIFA.

In conventional designs of a microstrip antenna or PIFA with a parasitic element, the parasitic element is usually placed adjacent to the radiating element which leads to increased linear dimensions and volume of the antenna. In the proposed single feed tri-band PIFA design of this invention, the parasitic element is placed in the area between the radiating element and the ground plane thereby resulting in neither an increased volume nor increased linear dimensions thus accomplishing the compactness of the multi-band PIFA structure. Thus the single feed multi-band PIFA design of this invention also has the desirable feature of compactness of the overall volume of the PIFA.

A conventional single band PIFA assembly 100 is illustrated in FIGS. 5*a* and 5*b*. The PIFA 100 shown in FIG. 5*a* and FIG. 5*b* consists of a radiating element 101, a ground plane 102, a connector feed pin 104*a*, and a conductive post or pin 107. A power feed hole 103 is located corresponding to the radiating element 101. A connector feed pin 104*a* serves as a feed path for radio frequency (RF) power to the radiating element 101. The connector feed pin 104*a* is inserted through the feed hole 103 from the bottom surface of the ground plane 102. The connector feed pin 104*a* is electrically insulated from the ground plane 102 where the pin 104*a* passes through the hole in the ground plane 102. The connector feed pin 104*a* is electrically connected to the radiating element 101 at 105*a* with solder. The body of the feed connector 104*b* is electrically connected to the ground plane at 105*b* with solder. The connector feed pin 104*a* is electrically insulated from the body of the feed connector 104*b*. A through hole 106 is located corresponding to the radiating element 101, and the conductive post or pin 107 is inserted through the hole 106. The conductive post 107 serves as a short circuit between the radiating element 101 and the ground plane 102. The conductive post 107 is electrically connected to the radiating element 101 at 108*a* with solder. The conductive post 107 is also electrically connected to the ground plane 102 at 108*b* with solder. The resonant frequency of the PIFA 100 is determined by the length (L) and width (W) of the radiating element 101 and is slightly affected by the locations of the feed pin 104*a* and the shorting pin 107. The impedance match of the PIFA 100 is achieved by the adjusting of the diameter of the connector feed pin 104*a*, by adjusting the diameter of the conductive shorting post 107, and by adjusting the separation distance between the connector feed pin 104*a* and the conductive shorting post 107.

SUMMARY OF THE INVENTION

This invention comprises a single feed PIFA having triple resonance which covers the dual cellular band as well as the GPS or Bluetooth frequency bands. The present invention involves a modification of the single feed dual band PIFA design to cover an additional non-cellular resonant frequency band resulting in tri-band operation of the PIFA. Such a PIFA design clearly falls into the classical definition of multi-band category. In the proposed invention, the resonant frequencies of dual cellular bands are realized by the design of conventional dual band PIFA using the shorting post and slot techniques. The resonance in the non-cellular band (which is distinctly far off from the cellular bands) constituting the third resonant frequency of the PIFA, is generated by the shorted parasitic element placed in the region between the radiating element and the ground plane of the PIFA. The size, the position of the parasitic element as well its separation distance from the radiating element of the PIFA are the prime parameters determining its resonant frequency and the bandwidth of the non-cellular band. Because of the close proximity of the parasitic element to the radiating element, the design of such a single feed multi-band (tri) PIFA involves the optimization of the coupling of the parasitic element with the radiating element to provide the desired multiple (more than two) resonant frequencies as well as the bandwidth centered around them. The design configuration of the single feed tri-band (AMPS/PCS/GPS) PIFA covering the dual cellular and non-cellular GPS frequencies forms the first embodiment of this invention. In the single feed tri-band PIFA proposed in the first embodiment of this invention, the dual cellular resonant frequencies of AMPS/PCS bands are obtained by the selective placement of the two linear slots on the radiating element of the PIFA. The two linear slots of the radiating element are on opposite sides with respect to the position of the shorting post of the PIFA. In the PIFA design of the first embodiment of this invention, the resonance in the non-cellular (GPS) band forming the third resonant band of tri-band PIFA operation is realized through the design of the shorted parasitic element placed in the region between the radiating element and the ground plane of the PIFA. The second embodiment of this invention illustrates the design configuration of the single feed tri-band (GSM/DCS/ISM) PIFA covering the dual cellular and non-cellular Bluetooth or ISM bands. In the single feed tri-band (GSM/DCS/ISM) band PIFA design of the second embodiment of this invention, the dual cellular resonant frequencies of GSM/DCS bands are generated by the selective combination of a L-shaped slot as well as a linear slot in the radiating element of the PIFA. Even in the second embodiment of this invention, the L-shaped slot and the linear slot in the radiating element are on opposite sides with respect to the position of the shorting post of the PIFA. In the second embodiment of this invention also, the resonance in the non-cellular (ISM) band constituting the third band of the tri-band PIFA operation is again realized through the design of the shorted parasitic element positioned in the region between the radiating element and the ground plane of the PIFA. The single feed tri-band PIFAs developed based on the enunciated concepts proposed in the two embodiments of this invention exhibit satisfactory gain and bandwidth at the dual cellular as well as non-cellular bands of interest. Since the design of this invention realizes multiple (more than 2) resonant frequencies at the cellular and non-cellular bands, practically it is much easier to achieve the required bandwidth centered around the multiple resonant frequencies for the tri-band operation of PIFA. For example, to extend the operation of the cellular dual band (AMPS/PCS) PIFA to include the GPS band, the proposed PIFA design of this invention requires a bandwidth of 7.29% in PCS band and 0.13% in GPS band instead of a bandwidth of 23.35% to cover the combined GPS/PCS bands (1575 to 1990 MHz). Similarly, to extend the operation of the cellular dual band (GSM/DCS) PIFA to cover the ISM band, the PIFA design proposed in this invention requires a bandwidth of 9.47% in DCS band and 4.08% in ISM band instead of a bandwidth of 37.52% for combined DCS/ISM bands (1710 to 2500 MHz). Therefore the proposed single feed tri-band PIFA design scheme of this invention has the novel feature to overcome the enormity of the bandwidth requirement centered around any specific resonance to cover the dual cellular and non-cellular frequency bands.

In conventional designs of a microstrip antenna or a PIFA with a parasitic element, the parasitic element is usually placed adjacent to the radiating element resulting in the increase in the linear dimension of the antenna. In the proposed design of this invention, the parasitic element placed between the radiating element and the ground plane results in neither the increased volume nor the increased linear dimensions thus accomplishing the compactness of the multi-band PIFA structure. This is contrary to the conventional design of parasitic elements. Thus the single feed multi-band PIFA design of this invention has the desirable feature of compactness of PIFA volume. This clearly is a distinct additional advantage of the design proposed in this invention.

Further, in most of the prior art designs, the parasitic elements are usually employed to improve the bandwidth of the main (driven) radiating element and not for the formation of an additional resonant band. In this invention, the design of the parasitic element of the PIFA is solely intended for the realization of an exclusive resonant band that is distinctly separate from the dual resonant frequencies of the main radiating element of the PIFA. The simultaneous realization of multiple distinct resonance at dual cellular and non-cellular bands of a single feed PIFA with parasitic element seems to have not been reported in open literature. The proposed PIFA design of this invention also has the desirable feature of improved F/B ratio without significant drop in the gain performance of the antenna. This is probably due to the presence of the parasitic element affecting the interaction between the radiating element and the ground plane of the PIFA.

One of the principal objectives of this invention is to provide a single feed tri-band PIFA for the simultaneous coverage of dual cellular (AMPS/PCS, GSM/DCS) and non-cellular (GPS/ISM) frequency bands.

A further objective of this invention is to provide a single feed tri-band PIFA which is devoid of the enormity of the bandwidth requirement centered around any specific resonant frequency for the simultaneous coverage of dual cellular and non-cellular (GPS/ISM) frequency bands.

Another objective of this invention is to ensure that the evolved scheme for the design of a single feed tri-band PIFA for the simultaneous coverage of dual cellular and non-cellular (GPS/ISM) frequency bands does not involve an increase in the overall volume of the PIFA.

Yet another objective of this invention is to provide a single feed tri-band PIFA having additional degrees of freedom to control the resonance and the bandwidth characteristics of the antenna.

Still another objective of this invention is to provide a single feed PIFA which has the three distinct resonant frequencies in dual cellular and non-cellular bands.

Another objective of this invention is to provide a single feed tri-band PIFA having the desirable features of configuration simplicity, compact size, cost effective to manufacture and ease of fabrication.

These and other objects will be apparent to those skilled in the art.

DESCRIPTION OF THE PREFERRED EMBODIMENTS

Figure 1A:
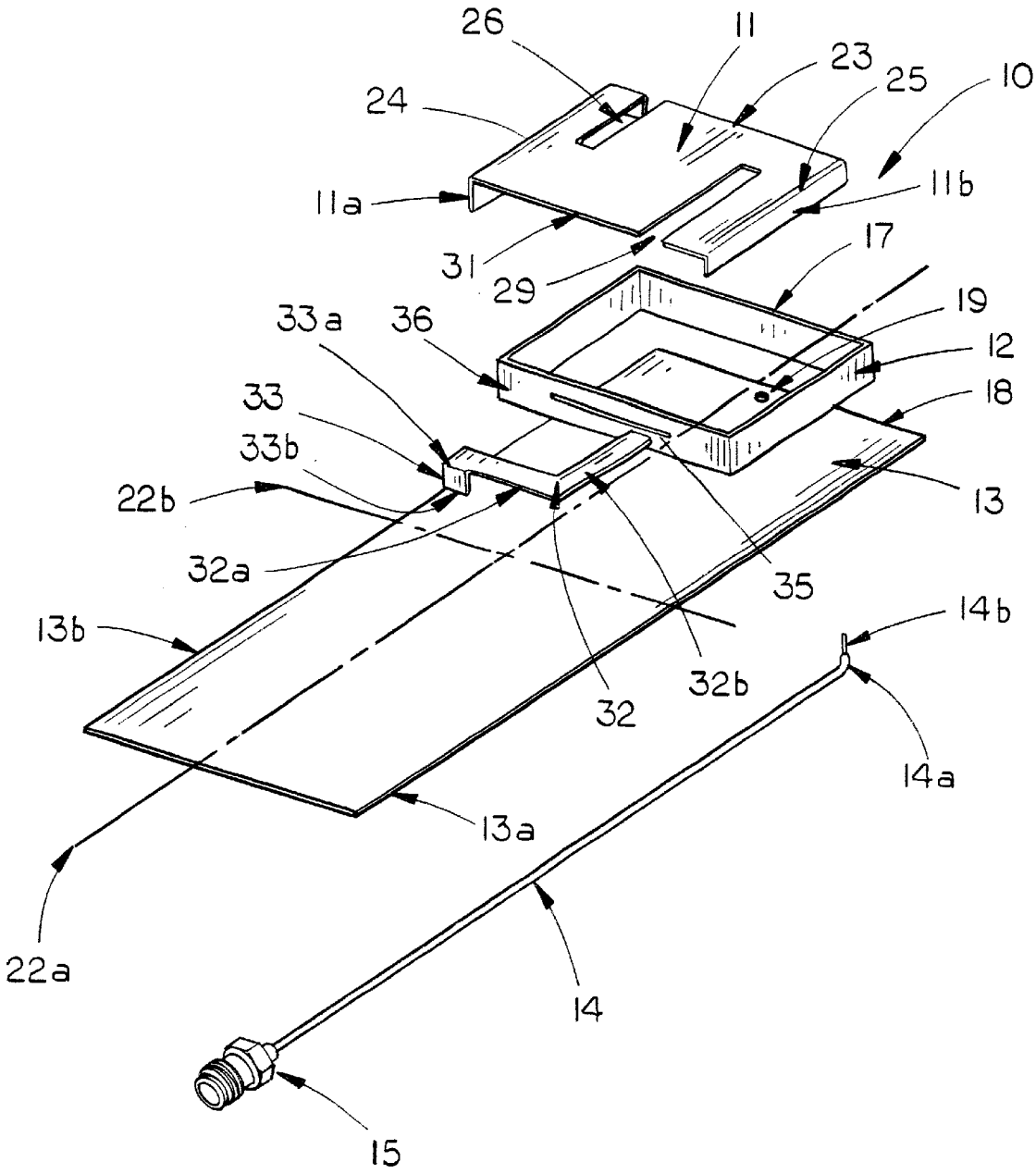
FIG. 1*a* is an exploded perspective view of a first embodiment of the single feed tri-band PIFA of this invention.

Preferred embodiments of the present invention are now explained while referring to the drawings.

Figure 1B:
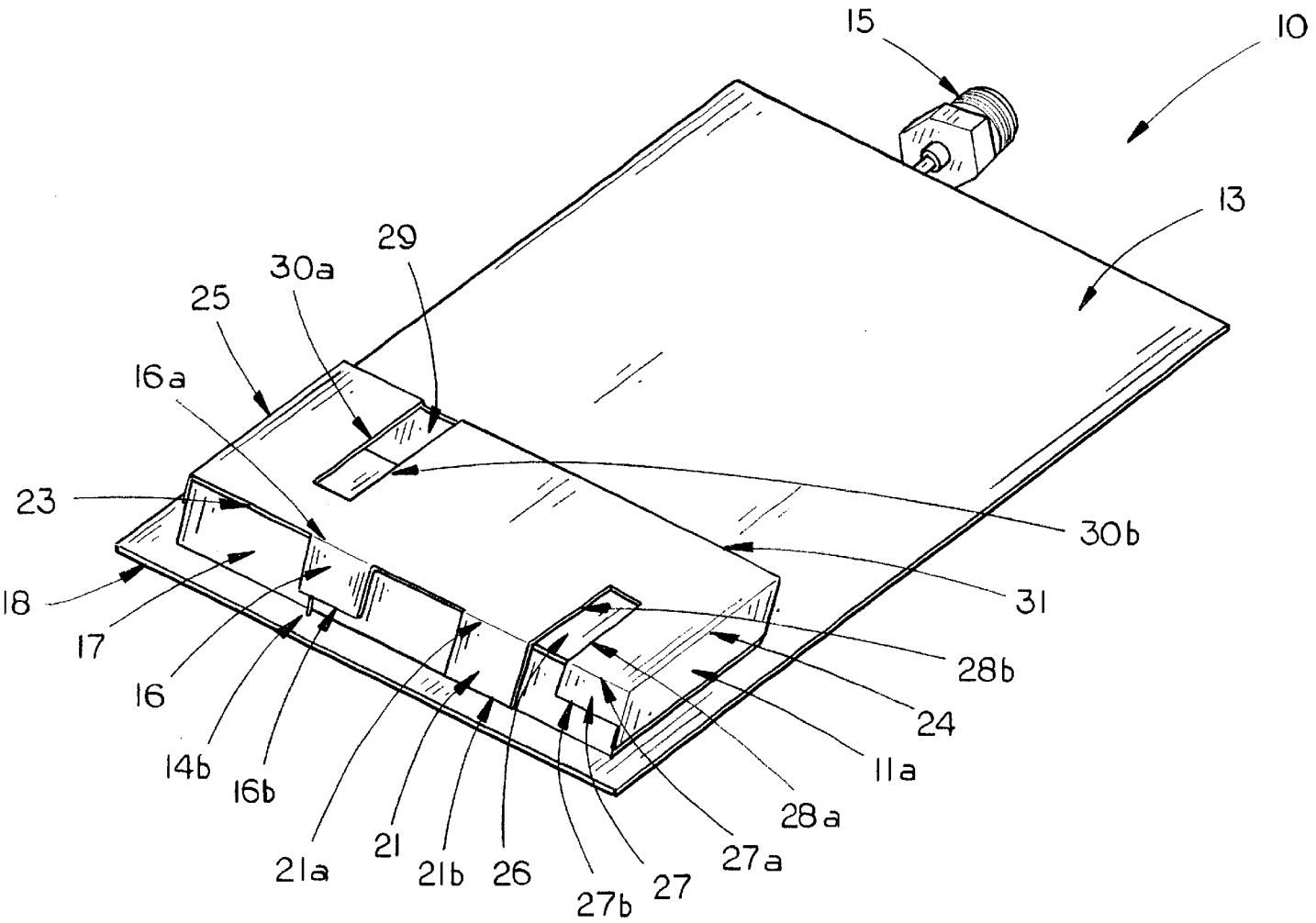
FIG. 1*b* is an exploded perspective view of the single feed tri-band PIFA of this invention.
Figure 1C:
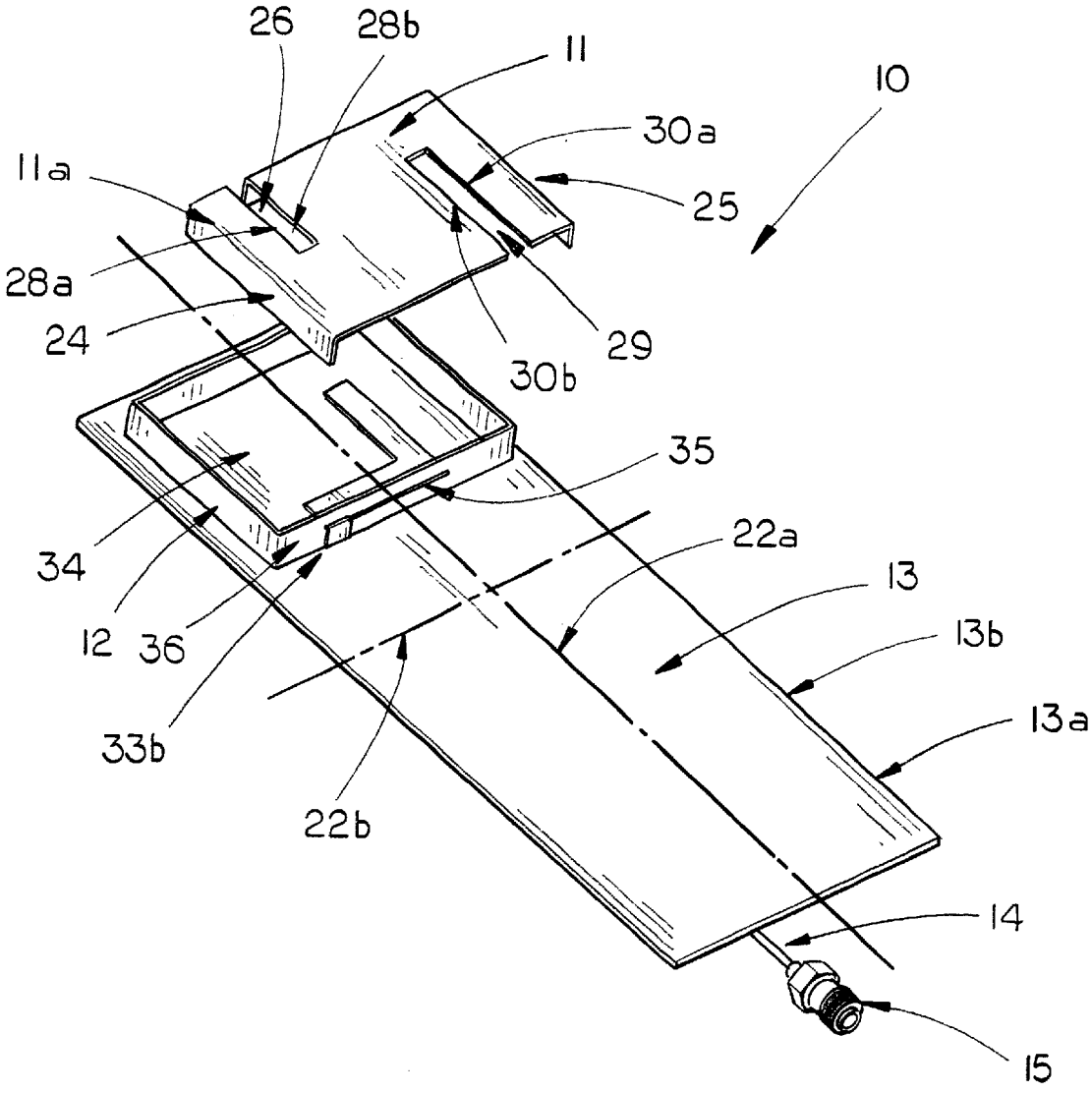
FIG. 1*c* is an exploded perspective view of the embodiment of FIG. 1*a* and FIG. 1*b;*
Figure 1D:
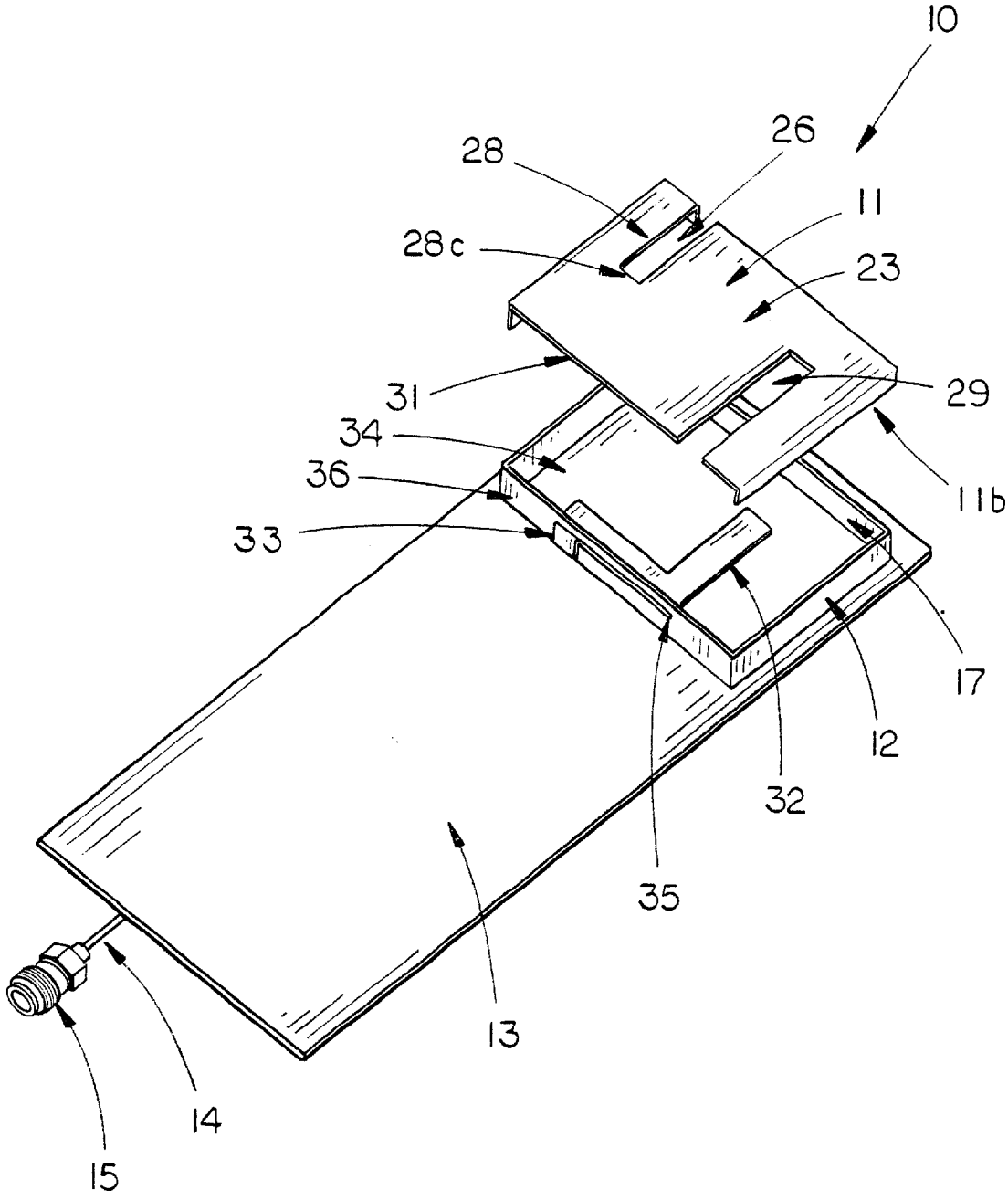
FIG. 1*d* is a partial exploded perspective view of the radiating element, the dielectric carriage, the parasitic element, the ground plane and the feed cable of the first embodiment.

In the accompanying text describing the first embodiment of a single feed tri-band PIFA 10 of this invention, refer to the FIGS. 1*a*, 1*b*, 1*c* and 1*d* for illustrations. The PIFA 10 includes a radiating element 11 that is positioned on a dielectric carriage 12. The dielectric carriage 12 with four side walls is positioned above the ground plane 13. A coaxial cable 14 serves as an electrical path for radio frequency (RF) power to the radiating element 11. The coaxial cable 14 terminates in a RF connector 15 (FIG. 1*a*). A conductive strip 16 forms a feed tab for the radiating element 11 of the PIFA 10. One end of the feed tab 16 is connected to the radiating element 11 at 16*a*. The other (free) end 16*b* of the feed tab 16 lies above the ground plane 13 in a spaced-apart relationship thereto. The feed tab 16 of the PIFA is flush with the outer surface of the side wall 17 of dielectric carriage 12 (FIG. 1*b*). The side wall 17 of dielectric carriage 12 is located very close to the top edge 18 of the ground plane 13. A feed hole 19 of suitable diameter is provided in ground plane 13 adjacent feed tab 16. Feed hole 19 is located between the outer surface of the side wall 17 of the dielectric carriage 12 and the top edge 18 of the ground plane 13 (FIG. 1*a*). The open end of RF cable 14 is inserted through the feed hole 19 from bottom surface 13*a* of ground plane 13. While passing through feed hole 19, RF cable 14 is electrically isolated from the ground plane 13 through the insulator 14*a*. The center conductor 14*b* of the RF cable 14 emerging out of top surface 13*b* of ground plane 13 through the feed hole 19 is connected to free end 16*b* of feed tab 16. A conductive strip 21 serves as a short circuit between the radiating element 11 and ground plane 13 (FIG. 1*b*). The conductive strip 21 is electrically connected to the radiating element 11 at 21*a*. Conductive strip 21 is also connected to ground plane 13 at 21*b*. The short-circuiting element 21 apart from facilitating the quarter wavelength of operation for the radiating element also performs the role of a tuning element. The shorting strip 21 drawn away from the major axis 22*a* of ground plane 13 and positioned along the front edge 23 of radiating element 11 controls the separation between the lower and upper resonant frequency bands of radiating element 11. Radiating element 11 is bent 90° along its left edge 24 to form a vertical plane 11*a*. The other (free) end of vertical plane 11 a is at a specific distance above ground plane 13. Vertical plane 11*a* serves as a capacitive loading plate for tuning the lower resonant frequency of radiating element 11. Radiating element 11 is also bent 90° along its right edge 25 to form a vertical plane 11*b* (FIG. 1*d*). The free end of the vertical plane 11*b* is also at a specific distance above the ground plane 13. Vertical plane 11*b* forms a capacitive loading plate for tuning the upper resonant frequency of the radiating element 11. Slot 26 is formed in radiating element 11 between shorting strip 21 and the left edge 24 to form a reactive loading element to lower the resonant frequency of the lower band without increasing the physical size of the radiating element 11. The axis of the slot 26 is parallel to the major axis 22*a* of the ground plane 13 (FIG. 1*a*). A conductive strip forms a matching stub 27 to the radiating element 11 (FIG. 1*b*). The matching stub 27 is attached to radiating element 11 along the front edge 23 of radiating element 11 and the stub 27 covers that portion of the front edge 23 contained between contour 28*a* of slot 26 and the left edge 24. One end of stub 27 is connected to radiating element 11 at 27*a*. The other (free) end 27*b* of matching stub 27 is at a pre-desired distance above ground plane 13. The width of stub 27 as well as the perpendicular distance between its free end 27*b* and ground plane 13 are also parameters that control the resonance and bandwidth characteristics of radiating element 11. The matching stub 27 has a profound effect on the lower resonant band of radiating element 11 of the PIFA 10. Another slot 29 is formed in radiating element 11 along back edge 31 thereof. The slot edge 30*a* of slot 29 is closer to the right edge 25 of radiating element 11 (FIG. 1*b*). The front edge 23 and the back edge 31 located on the opposite ends of radiating element 11, apart from being parallel to each other, are also parallel to the minor axis 22*b* of ground plane 13. The left edge 24 and the right edge 25 of radiating element 11 are parallel to each other and are also parallel to the major axis 22*a* of ground plane 13 (FIG. 1*a*). The location and width of slot 29 is chosen to restrict the line containing slot edge 30*b* of slot 29 to be at the right side of the feed tab 16 (FIG. 1*b*). The axis of slot 29 is parallel to the major axis 22*a* of ground plane 13. The slot 29 on radiating element 11 with its open end along the back edge 31 of radiating element 11 forms a prominent reactive loading element to lower the resonant frequency of the upper band without increasing the physical size of radiating element 11. A parasitic element 32 is designed to provide an exclusive resonance to cover the non-cellular frequency band of the proposed tri-band operation of PIFA 10 (FIG. 1*a*). Parasitic element 32 is substantially L-shaped comprising two segments 32*a* and 32*b*. Segment 32*a* of parasitic element 32 has a maximum linear dimension along the direction of the minor axis 22*b* of ground plane 13. Likewise, the maximum linear dimension of segment 32*b* of parasitic element 32 is oriented along the direction of the major axis 22*a* of ground plane 13. The parasitic element 32 has a vertical attachment tab 33 to facilitate its connection to the ground plane 13. To facilitate the placement of parasitic element 32 in the interior region 34 between radiating element 11 and ground plane 13, a slot 35 is formed in the back side wall 36 of the dielectric carriage 12 (FIG. 1*c*). The width of slot 35 is chosen to allow easy movement of the parasitic element 32 therethrough for placing it into the region 34. One end of vertical attachment or tab 33 is connected to parasitic element 32 at 33*a*. The other end of vertical attachment or tab 33 is connected to ground plane 13 at 33*b*. The connection of parasitic element 32 (through its vertical attachment 33) to ground plane 13 allows it to function as a shorted parasitic radiator to radiating element 11. The height of vertical attachment 33 and the height of slot 35 (the dimension of the slot 35 along the height of the dielectric carriage 12) are chosen to place the shorted parasitic element 32 at a pre-designed height with respect to both radiating element 11 as well as ground plane 13. The small height of slot 35 holds the segment 32*a* firmly to back side wall 36 of dielectric carriage 12 at a desired height from the ground plane (FIG. 1*a*). The parasitic element 32 is positioned to confine it within the interior region 34 by ensuring that the vertical attachment 33 shall always be in flush with the outer surface of back side wall 36 of dielectric carriage 12 (FIG. 1*d*). This imposed restriction on the flush placement of vertical attachment 33 with the outer surface of back side wall 36 prevents parasitic element 32 from protruding out of dielectric carriage 12 through slot 35 on back side wall 36 of dielectric carriage 12.

The maximum length (dimension along the major axis 22*a* of ground plane 13) of segment 32*a* is always chosen to be less than the distance between slot edge 28*c* of slot 26 and back edge 31 of radiating element 11 (FIG. 1*d*). This limit on the maximum length of segment 32*a* of parasitic element 32 prevents the extension of segment 32*a* of parasitic element 32 into the projected area of slot 26 as seen from the top of radiating element 11. The maximum width (dimension along the minor axis 22*b* of ground plane 13) of segment 32*a* should always be smaller than the perpendicular distance between left edge 24 of radiating element 11 and the straight line containing slot edge 30*b* (of slot 29) (FIG. 1*c*). This limit on the maximum width of segment 32*a* of parasitic element 32 prohibits the extension of segment 32*a* of parasitic element 32 into the projected area of slot 29 as seen from the top of radiating element 11.

The maximum length (dimension along the major axis 22*a* of ground plane 13) of segment 32*b* is always chosen to be less than the distance between the inner surfaces of front side wall 17 and back side wall 36 of dielectric carriage 12 (FIG. 1*a*). If the above restriction is not imposed on the maximum length of segment 32*b* of parasitic element 32 and if the length of segment 32*b* is allowed to exceed the distance between the inner surfaces of side walls 17 and 36 of carriage 12, segment 32*b* and therefore the parasitic element 32 cannot be held in the desired position inside interior region 34 without being bent. The maximum width (dimension along the minor axis 22*b* of ground plane 13) of segment 32*b* should always be smaller than the perpendicular distance between the straight line containing slot edge 28*b* of slot 26 and the straight line containing slot edge 30*b* of slot 29 (FIG. 1*c*). This limit on the maximum width of segment 32*b* of parasitic element 32 prevents the extension of segment 32*b* of parasitic element 32 into the projected areas of the slots 26 and 29 as seen from the top of radiating element 11.

The configuration of PIFA 10 illustrated in FIGS. 1*a*, 1*b*, 1*c* and 1*d* functions as a single feed tri-band PIFA. In the absence of parasitic element 32, the resonant frequencies of the cellular lower and upper frequency bands of radiating element 11 of the PIFA 10 are determined by: the dimensions of radiating element 11 and vertical planes 11*a* and 11*b*, dielectric constant of the material of dielectric carriage 12, the thickness of the four side walls of dielectric carriage 12, the location and the width of feed stub 16, the location and the width of shorting strip 21, the length of slot 26, the length of slot 29, the position of slot 26, the position of slot 29, the width of stub 27 and the distance between the free end 27*b* of stub 27 and ground plane 13. The bandwidth of the single feed tri-band PIFA 10 centered around the resonant frequencies of the lower and upper cellular frequency bands is determined by: the width of feed tab 16, the location of feed tab 16, the location of shorting strip 21, the width of shorting strip 21, the material property of dielectric carriage 12, the width of stub 27 and the distance between the free end 27*b* of stub 27 from ground plane 13 and the linear dimensions of radiating element 11 including the height of PIFA 10. With the introduction of the shorted parasitic element 32 into the interior region 34 of PIFA 10 (as shown in FIG. 1*c*), the resonance characteristics of PIFA 10 described above are altered because of the effect of mutual coupling between radiating element 11 and parasitic element 32. The degree of change in the resonance characteristics of PIFA depends upon the relative proximity of the resonant frequency of the shorted parasitic element 32 to the lower and upper resonant frequencies of radiating element 11. If the dual resonant frequency bands of radiating element 11 of the PIFA 10 (without the shorted parasitic element 32) are closer to the desired additional non-cellular resonance to be realized through the parasitic element, the suggested introduction of parasitic element 32 into the interior region 34 of PIFA 10 will have a significant effect to alter the prior resonance characteristics of radiating element 11. As a result, greater deviations to the original (initial) dual resonant frequencies of radiating element 11 can be noticed with the insertion of parasitic element 32 into interior region 34 of the PIFA. The resonant frequency of the shorted parasitic element 32 depends on: the size of parasitic element 32, the location of point 33*b* connecting vertical attachment 33 to ground plane 13, the location of point 33*a* of vertical attachment 33 of parasitic element 32 and the height of vertical attachment 33 above ground plane 13 (FIG. 1*a*)

The single feed tri-band operation of the PIFA 10 is achieved by adapting the following design sequence. With the prior choice of the design parameters that control the resonance and bandwidth characteristics of radiating element 11 (without the parasitic element 32), the desired lower and upper resonant frequencies of the cellular dual band PIFA are realized. With these preset design parameters and the resulting geometrical configuration of radiating element 11 fixed accordingly, parasitic element 32 is inserted into interior region 34 of dielectric carriage 12 to realize the additional resonant frequency of the PIFA in the non-cellular band. The desired resonance of PIFA 10 in the non-cellular frequency band is accomplished through the optimization of the geometrical parameters of the shorted parasitic element 32 as well as its relative position with respect to radiating element 11 and ground plane 13. Once the desired non-cellular resonance of the PIFA is realized with the positioning of parasitic element 32 in interior region 34 of dielectric carriage 12, the detuned radiating element 11 is reoptimized for its original dual resonance in dual cellular frequency bands. This is accomplished by controlling the geometric parameters of radiating element 11 that control its resonance characteristics. Often, an iterative design cycle of alternate turns of tuning the radiating element 11 and the shorted parasitic element 32 is required for the simultaneous realization of desired dual resonance in cellular bands and the resonance in the non-cellular bands.

Figure 2:
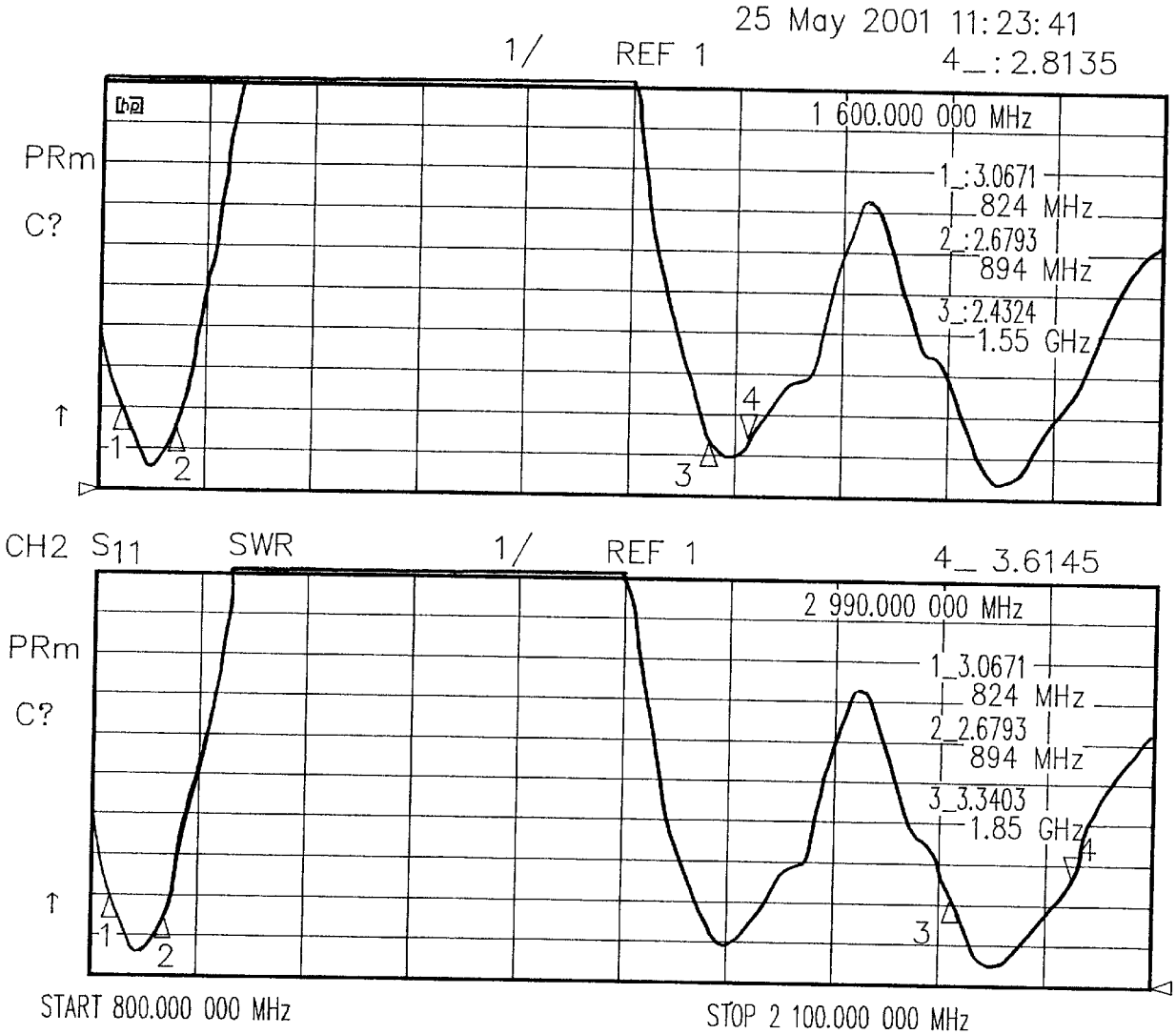
FIG. 2 is a frequency response chart which depicts the characteristics of the VSWR of the single feed tri-band PIFA of FIG. 1.
Figure 5A:
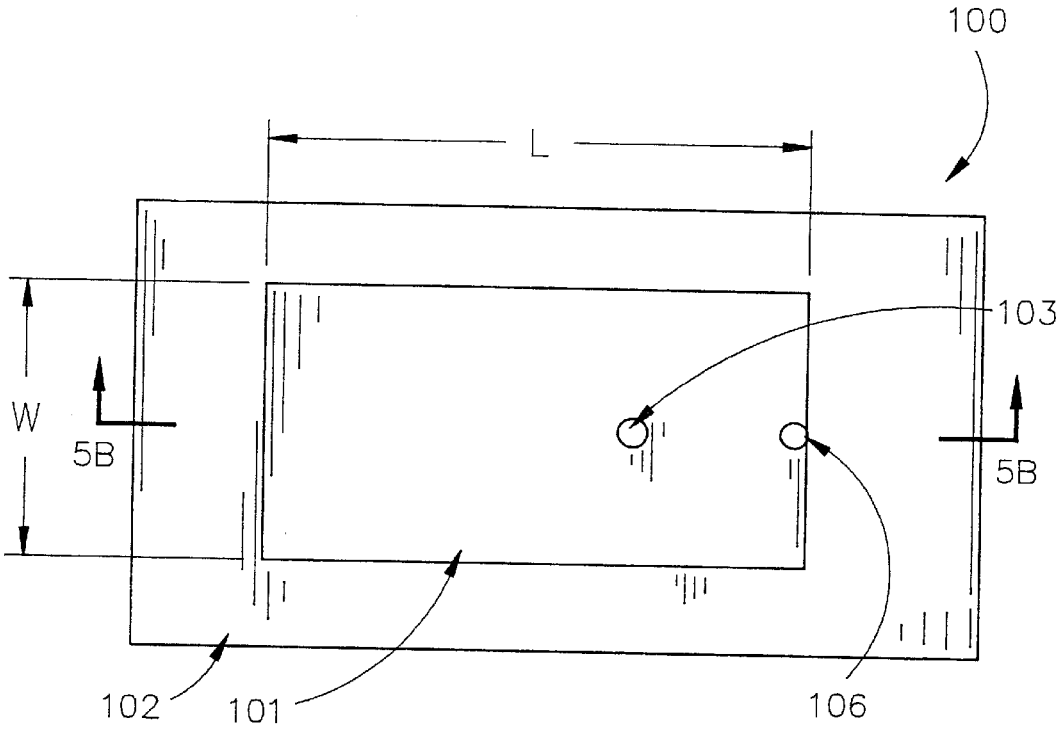
FIG. 5A (PRIOR ART)
FIG. 5*a* is a top view of a prior art single band PIFA.
Figure 5B:
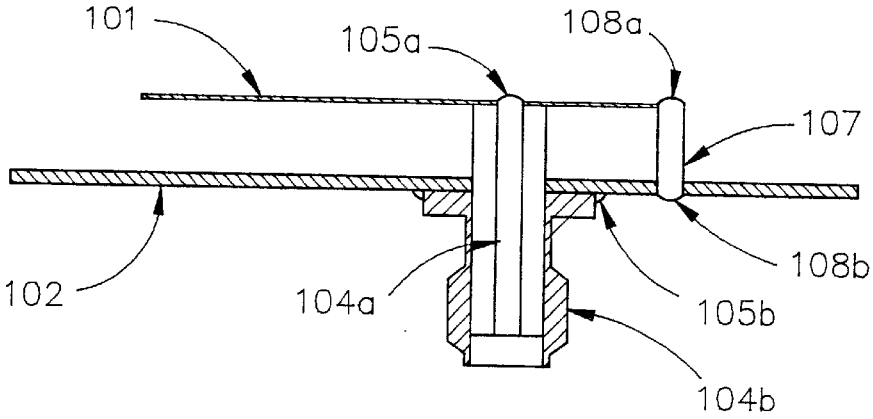
FIG. 5B (PRIOR ART)
FIG. 5*b* is a sectional view taken along the line 5B—5B of FIG. 5*a*.

Based on the concepts proposed in the first embodiment of this invention, a single feed tri-band (AMPS/PCS/GPS) PIFA has been designed and developed. The final configuration of the single feed tri-band PIFA 10 with an internal parasitic element is shown in FIG. 1*b*. The result of the tests conducted on the single feed tri-band PIFA 10 illustrated in FIGS. 1*a*, 1*b*, 1*c* and 1*d*, and referred to as the first embodiment of this invention is shown in FIG. 2. FIG. 2 illustrates the plots of VSWR of the single feed tri-band PIFA 10 resonating in the dual cellular (AMPS/PCS) bands and the non-cellular GPS band (1575 MHz). The plots of VSWR in FIG. 2 demonstrate satisfactory bandwidth for the tri-band operation of the PIFA covering simultaneously the dual cellular frequency bands and an additional non-cellular frequency band. The results of FIG. 2 also illustrate that the PIFA 10 of the first embodiment of this invention has realized three distinct resonant frequencies in AMPS, PCS and GPS bands. The requisite bandwidth for the tri-band PIFA operation has also been accomplished through the optimization of the bandwidth around the individual resonant frequencies only. Thus the single feed tri-band of PIFA 10 proposed as the first embodiment of this invention has the novel feature of overcoming the enormity of the bandwidth requirement around any specific resonant frequency to cover dual cellular and an additional non-cellular frequency band. The final configuration of PIFA 10 arrived at for the tri-band operation is a modification of the single feed dual band PIFA structure. The modifications proposed in the first embodiment this invention to achieve the final design configuration for single feed tri-band PIFA performance do not involve an increase in the overall physical size or volume of the original single feed dual band structure PIFA. The radiating element 11 with dual slots 26 and 29, vertical planes 11*a* and 11*b*, feed tab 16, shorting strip 21 and matching stub 27 are configured to facilitate their formation in one process of continuous and sequential bending of a single sheet of metal resulting in improved manufacturability. This facilitates the relative ease and cost effectiveness of fabrication of a single feed tri-band PIFA 10. The dimensions of the single feed tri-band PIFA 10 are: Length=30 mm. Width=42 mm. and Height=8 mm. The projected semi perimeter of the single feed tri-band PIFA 10 is 72 mm as compared to the semi-perimeter of 87.31 mm required for a conventional single band PIFA 100 (FIG. 5) resonating only in the AMPS band. The measured radiation patterns of the single feed tri-band (AMPS/PCS/GPS) PIFA 10 having an internal parasitic element also confirm relatively improved Front to Back (F/B) ratio in the AMPS band than the conventional dual band (AMPS/PCS) PIFA without the parasitic element. This is probably due to the presence of the parasitic element affecting the interaction between the radiating element and the ground plane of the PIFA.

Figure 3A:
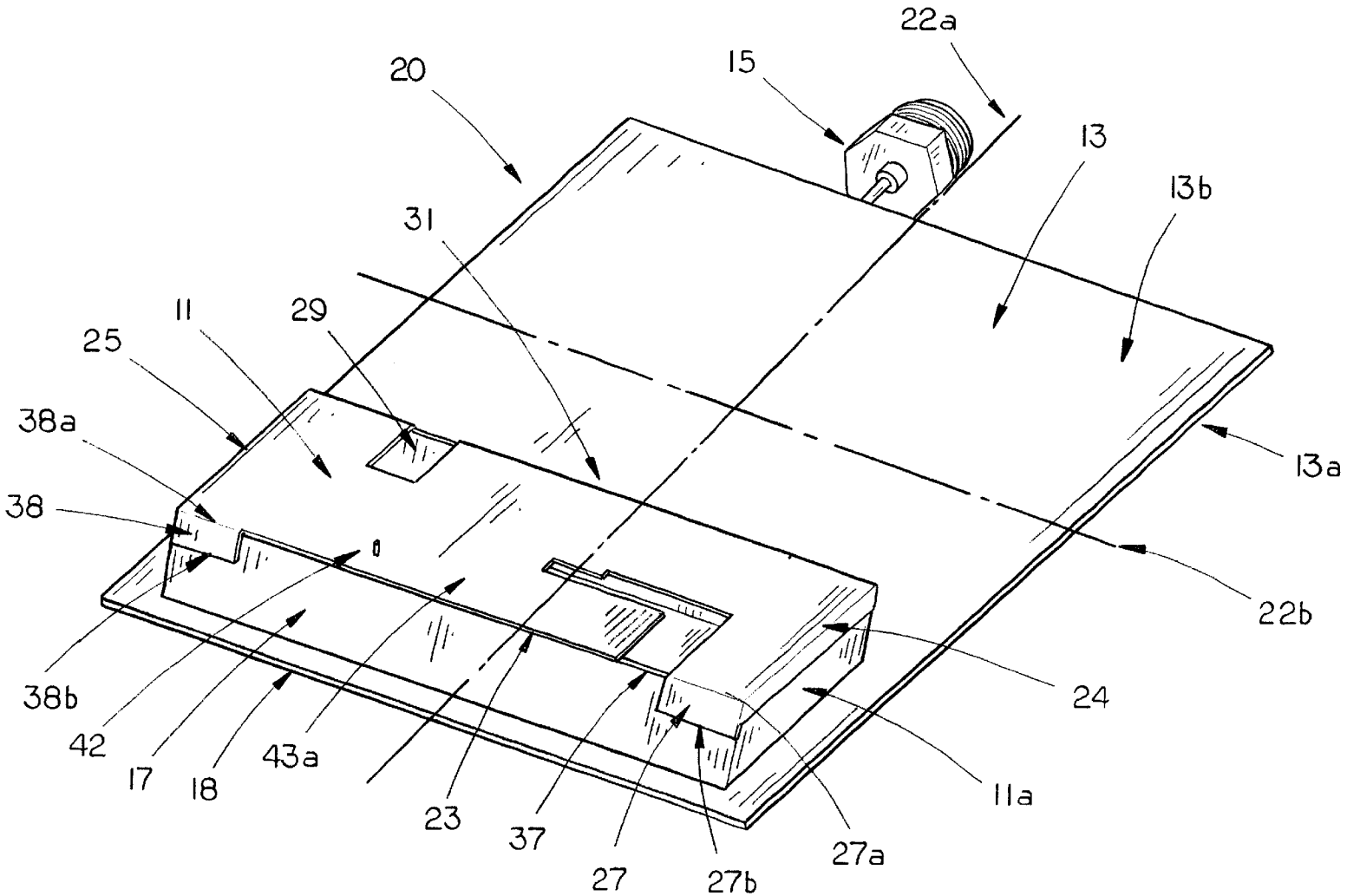
FIG. 3*a* is an perspective assembly view of the single feed tri-band PIFA of the second embodiment of this invention.
Figure 3B:
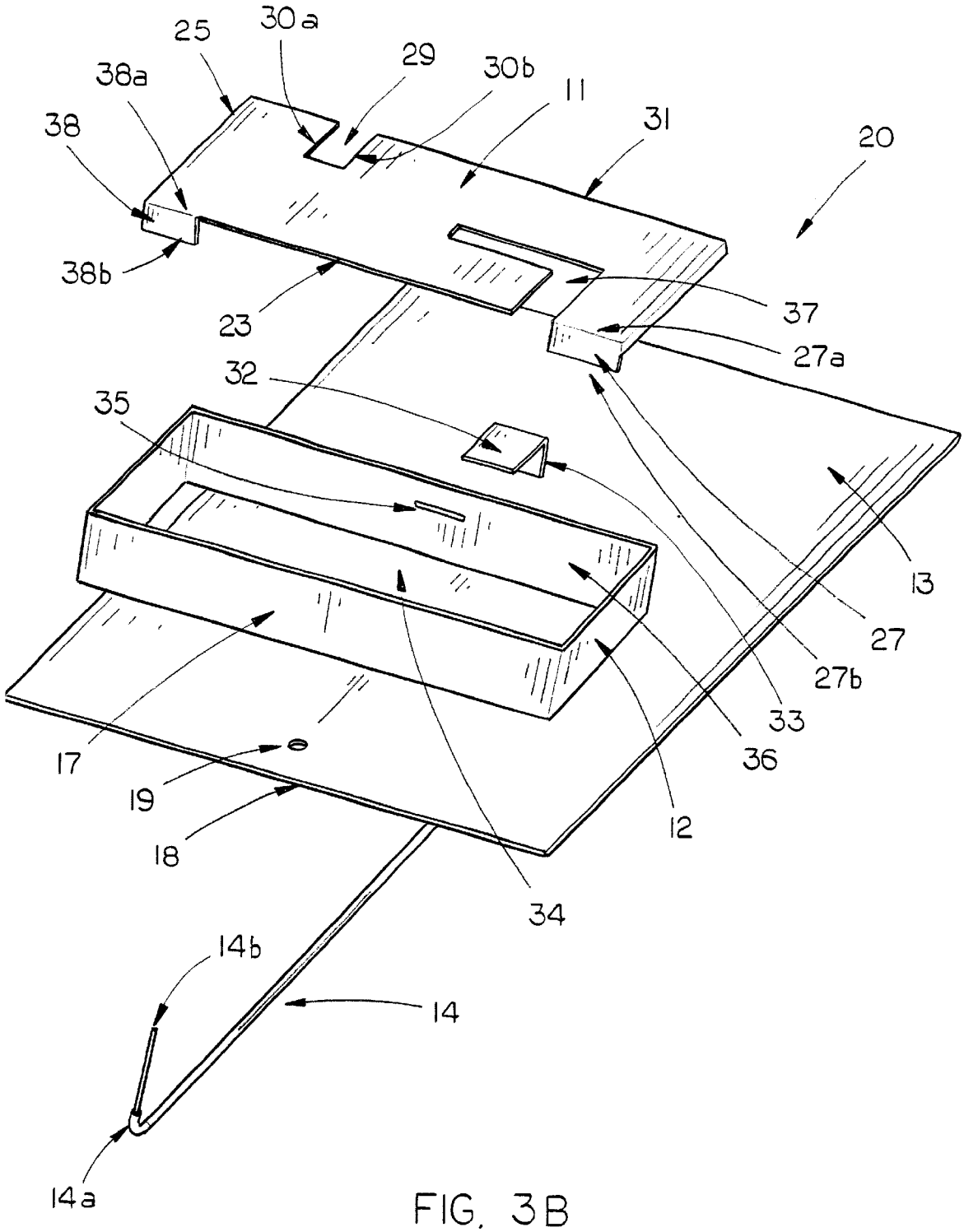
FIG. 3*b* is an exploded perspective view of the radiating element, the dielectric carriage, the parasitic element, the ground plane and the feed cable of the second embodiment.
Figure 3C:
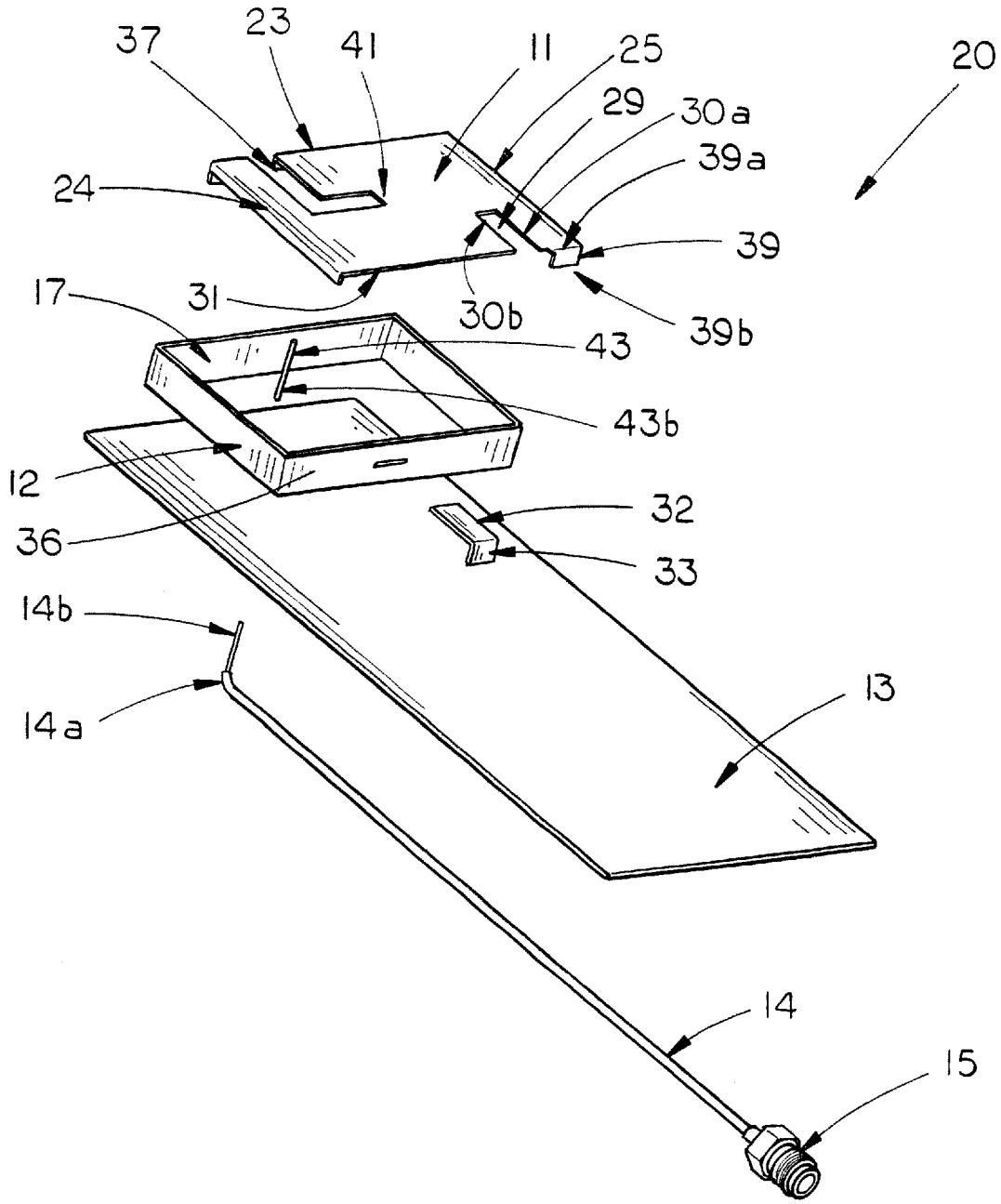
FIG. 3*c* is an exploded perspective view of the radiating element, the dielectric carriage, the parasitic element, the ground plane and the feed cable of the second embodiment.

In the accompanying text describing the single feed tri-band PIFA 20 of the second embodiment of this invention, reference is made to FIGS. 3*a*, 3*b*, 3*c* and 3*d*. The single feed tri-band PIFA 20 illustrated in FIGS. 3*a*–3*d* has an L-shaped slot 37 which replaces the linear slot 26 of the first embodiment of this invention. The slot 37 offers a reactive loading to tune both the lower and upper resonant frequencies of radiating element 11. An additional conductive tab (matching stub) 38 is attached to the front edge 23 of radiating element 11. The stub 38 is on the opposite corner with respect to the location of the stub 27 of PIFA 10. The conductive tab 38 is flush with outer surface of front side wall 17 of dielectric carriage 12. Stub 38 covers that portion of front 23 edge of radiating element 11 contained between the right edge 25 and feed point 42 (FIG. 3*a*). A conductive tab forms a second matching stub 38 of PIFA 20 in addition to matching stub 27. One end of stub 38 is connected to radiating element 11 at 38*a*. The free end 38*b* of stub 38 is spaced at a pre-desired distance above the ground plane 13. Stub 38 forms a tuning element to control the resonance and the bandwidth characteristics of the upper frequency band of radiating element 11. The conductive tab or stub 38 is flush with the outer surface of front side wall 17 of dielectric carriage 12. Another conductive tab or stub 39 is attached to back edge 31 of radiating element 11 (FIG. 3*c*). Conductive tab 39 constitutes the third matching stub of PIFA 20 in addition to the matching stubs 27 and 38. The conductive tab 39 is flush with the outer surface of back side wall 36 of dielectric carriage 12. The width of conducting tab 39 on back edge 31 of radiating element 11 covers the region between slot edge 30*a* and right edge 25 of radiating element 11 (FIG. 3*c*). One end of tab 39 is connected to radiating element 11 at 39*a*. The free end 39*b* of metal tab 39 is spaced at a specific distance above ground plane 13. Tab 39 serves as a tuning element to optimize the resonance and the bandwidth characteristics of the upper frequency band of radiating element 11. Unlike the case of PIFA 10 of the previous embodiment, the shorted parasitic element 32 of PIFA 20 of this embodiment has only a single segment. The maximum length (dimension along the major axis 22*a* of the ground plane 13) of parasitic 32 is always chosen to be less than the distance between the inner surfaces of front side wall 17 and back side wall 36 of dielectric carriage 12 (FIG. 3*b*). If the above restriction is not imposed on the maximum length of parasitic element 32 and if the length of parasitic element 32 is allowed to exceed the distance between the inner surfaces of side walls 17 and 36 of carriage 12, parasitic element 32 cannot be held in the desired position inside interior region 34 without being bent. Therefore the above restriction on the maximum length of parasitic element 32 ensures that it will always be held in desired position (devoid of undesirable bending) within interior region 34 even after vertical attachment 33 lies flush with the outer surface of back side wall 36 (FIG. 3*b*). The maximum width (dimension along minor axis 22*b* of ground plane 13) of parasitic element 32 should always be smaller than the perpendicular distance between the straight line containing slot edge 41 of slot 37 and the straight line containing slot edge 30*b* of slot 29 (FIG. 3*c*). This limit on the maximum width of parasitic element 32 prevents the extension of parasitic element 32 into the projected areas of slots 29 and 37 as seen from the top of radiating element 11.

Figure 3D:
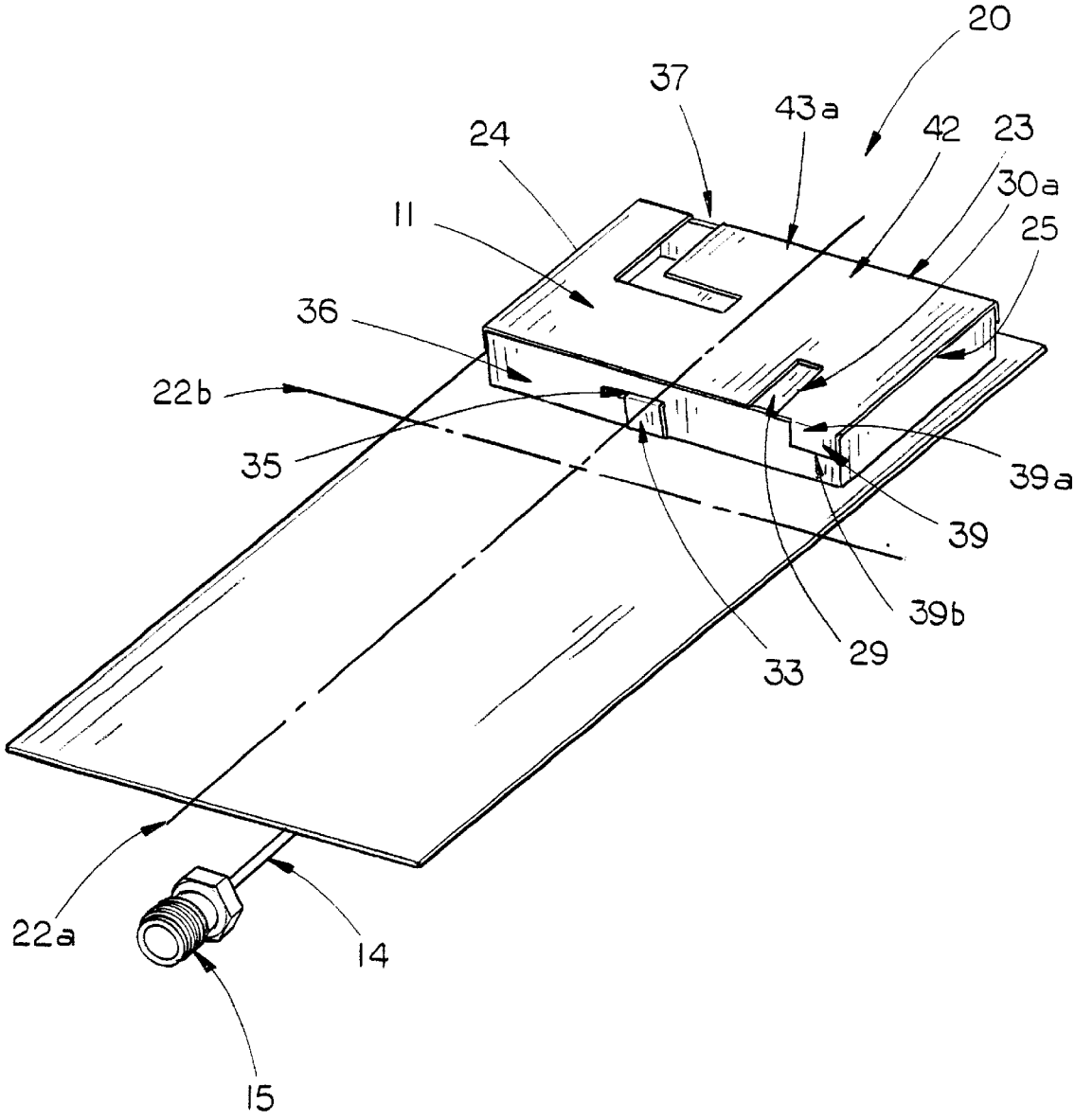
FIG. 3*d* is an exploded perspective view of the radiating element, the dielectric carriage, the parasitic element, the ground plane and the feed cable of the second embodiment.
Figure 4:
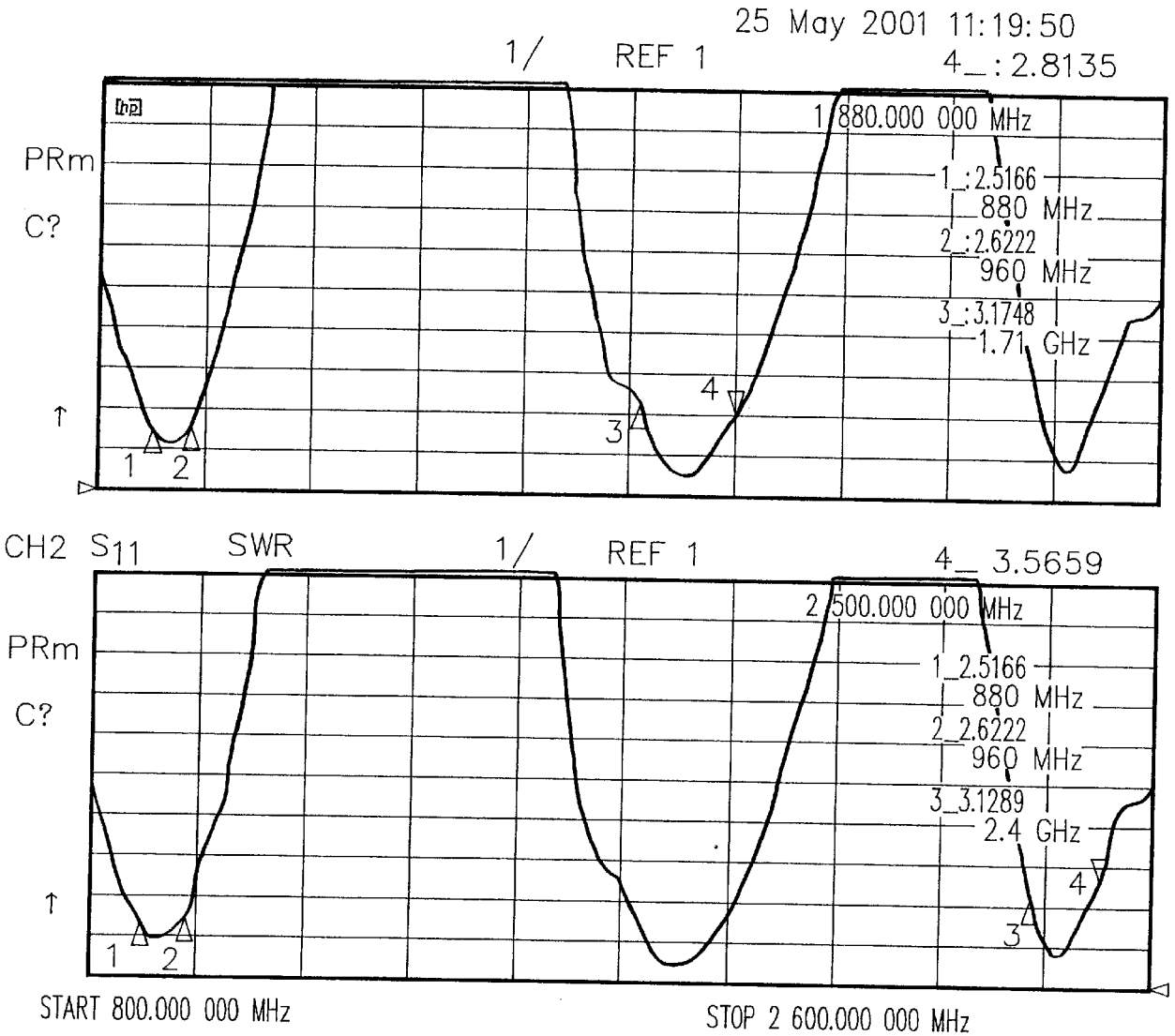
FIG. 4 is a frequency response chart which depicts the characteristics of the VSWR of the single feed tri-band PIFA of the second embodiment.

In the PIFA 20 of this embodiment, feed tab 16 is absent. Instead, center conductor 14*b* of RF cable 14 is directly connected (soldered) to radiating element 11 at 42 (FIG. 3*a*). In the PIFA 20, shorting strip 21 is absent and instead a conducting rod 43 serves as a short circuit between ground plane 13 and radiating element 11 (FIG. 3*c*). The shorting post 43 is connected to radiating element 11 at 43*a* (FIG. 3*c*). The shorting post 43 is also connected to ground plane at 43*b* (FIG. 3*c*). The positions of feed point 42 and shorting point 43*a* on radiating element 11 of PIFA 20 are located within the inner surface of front side wall 17 of dielectric carriage 12 (FIG. 3*a*). On the contrary, in PIFA 10 of the previous embodiment, feed tab 16 and shorting strip 21 are on the outer surface of front side wall 17 of dielectric carriage 12 (FIG. 11*b*). All the other elements of the single feed tri-band PIFA 20 illustrated in FIGS. 3*a*, 3*b*, 3*c* and 3*d* are identical to the single feed tri-band PIFA 10 illustrated in FIGS. 1*a*, 1*b*, 1*c* and 1*d* which has already been explained while describing the first embodiment of this invention. Further redundant explanation of the single feed tri-band PIFA 20 illustrated in FIGS. 3*a*, 3*b*, 3*c* and 3*d* will therefore be omitted. The configuration of PIFA 20 illustrated in FIGS. 3*a*, 3*b*, 3*c* and 3*d* functions as a single feed tri-band PIFA. In the absence of parasitic element 32, the lower and upper resonant frequencies of radiating element 11 of the cellular dual band PIFA 20 are determined by: the dimensions of radiating element 11 and vertical planes 11*a* and 11*b*, dielectric constant of the material of dielectric carriage 12, the thickness of the four side walls of dielectric carriage 12, the location of feed point 42, the diameter of shorting post 43, the position 43*a* of shorting post 43, the positions of slots 37 and 29, the dimensions of slot 37, the length of slot 29, the position of slot 37, the position of slot 29, the distance between free end 27*b* of stub 27 from ground plane 13, the distance between free end 38*b* of stub 38 from ground plane 13, and the distance between free end 39*b* of stub 39 from ground plane 13. The bandwidth of the single feed tri-band PIFA 20 centered around the resonant frequencies of the lower and upper cellular bands is determined by: the location of feed point 42, the location of shorting post 43, the diameter of shorting post 43, the material property of dielectric carriage 12, the width of stub 27, the width of stub 38, the width of stub 39, and the linear dimensions of radiating element 11 including the height of PIFA 20. The distances between ground plane 13 and the locations of free ends 27*b*, 38*b* and 39*b* of matching stubs 27, 38 and 39, respectively, are also the design parameters controlling the bandwidth of radiating element 11. As explained in the first embodiment of this invention, an iterative design cycle of alternate turns of tuning separating radiating element 11 and the shorted parasitic element 32 of PIFA 20 is required for the simultaneous realization of desired dual resonant frequencies of cellular bands and the resonant frequency of non-cellular band. Based on the concepts proposed in the second embodiment of this invention, a single feed tri-band (GSM/DCS/ISM) PIFA has been designed and developed. The final configuration of the single feed tri-band PIFA with an internal parasitic element is shown in FIGS. 3*a* and 3*d*. FIG. 4 illustrates the result of the tests conducted on the single feed tri-band PIFA 20 illustrated in FIGS. 3*a*, 3*b*, 3*c* and 3*d*, and referred to as the second embodiment of this invention. FIG. 4 depicts the plots of VSWR of the single feed tri-band PIFA 20 resonating in GSM/DCS/ISM bands. The plots of VSWR in FIG. 4 demonstrate satisfactory bandwidth for the tri-band operation of the PIFA covering simultaneously the dual cellular frequency (GSM/DCS) bands and an additional non-cellular frequency (ISM) band. The simultaneous realization of three distinct resonant frequencies in GSM, DCS and ISM bands is demonstrated in the results of the VSWR plots of FIG. 4. The requisite bandwidth for the tri-band operation of PIFA 20 has also been achieved through the optimization of the bandwidth around the individual resonant frequencies only.

Like the PIFA 10 of first embodiment, the single feed tri-band PIFA 20 of FIGS. 3*a*–3*d* also has the salient feature of overcoming the enormity of the bandwidth requirement around any specific resonant frequency to cover dual cellular and non-cellular frequency bands. The final configuration of PIFA 20 arrived at for the tri-band operation is a modification of the single feed dual band PIFA structure. The modifications proposed in the second embodiment of this invention to arrive at the final design configuration for a single feed tri-band PIFA performance do not involve an increase in the overall physical size or volume of original single feed dual band structure PIFA. The radiating element 11 with dual slots 37 and 29 and matching stubs 27, 38 and 39 of PIFA 20 can also be formed in a single process of continuous and sequential bending of a single sheet of metal resulting in improved fabrication ease. As mentioned in the previous embodiment, the single process formation of the different elements of the single feed tri-band PIFA 20 facilitates the relative ease and cost effectiveness of fabrication of the PIFA. The dimensions of the single feed tri-band PIFA 20 are: Length=30 mm. Width=42 mm. and Height=8 mm. The projected semi perimeter of the single feed tri-band PIFA 20 is 72 mm as compared to the semi-perimeter of 81.52 mm required for a conventional single band PIFA 100 (FIG. 5) resonating only in the GSM band.

As can be seen from the foregoing discussions and illustrations, a novel scheme for designing a single feed tri-band PIFA resonating in dual cellular and non-cellular frequency bands has been proposed and demonstrated. The embodiments of the proposed invention also demonstrate the realization of three distinct resonant frequencies in dual cellular and non-cellular frequency bands. The design schemes proposed in this invention effectively overcome the enormity of the combined bandwidth requirement of the upper resonance combining upper cellular (DCS/PCS) and non-cellular (ISM/GPS) frequency bands. The suggested design and implementation of the internal parasitic element as a tool to accomplish an exclusive resonance in non-cellular frequency bands do not involve an increase in the overall volume or size of the original dual cellular band PIFA. The radiating element with dual slots, the shorting strip, the feed tab, the multiple matching stubs of the proposed single feed tri-band PIFA are configured to facilitate their formations in one process of continuous and sequential bending of a single sheet of metal resulting in improved manufacturability. The distinct resonance of the single feed PIFA in three bands comprising dual cellular and noncellular frequency bands has been achieved without increasing the effective area of the antenna, thereby accomplishing the miniaturization of the size of the PIFA. The concepts of the slot loading and the capacitive loading techniques have been invoked in this invention to achieve the reduction of resonant frequency of the PIFA without increasing the size of the PIFA. The concept of using the position of the shorting strip (post) as a tuning element is an additional design feature of the proposed design of this invention. The single feed tri-band PIFA 10 and PIFA 20 of this invention are lightweight, compact, cost-effective and easy to manufacture.

Thus the novel design technique of single feed tri-band PIFA of this invention covering the dual cellular and non-cellular frequency bands accomplishes at least all of its stated objectives.

We claim:

1. A Planar Inverted F-Antenna (PIFA), comprising:

a ground plane;

a dielectric carriage positioned on said ground plane;

said dielectric carriage having left, right, front and back side walls;

said side walls of said dielectric carriage defining an interior region;

a radiating element positioned on said dielectric carriage having left, right, front and back edges, and a top surface;

said back side wall of said dielectric carriage having a slot formed therein;

a conductive shorting strip extending between said top surface of said radiating element at said front edge thereof and said ground plane;

a feed tab extending from said top surface of said radiating element towards said ground plane adjacent said front edge of said radiating element;

said shorting strip and feed tab being positioned adjacent said front side wall of said dielectric carriage;

a conductive strip having a tab portion extending therefrom;

said conductive strip being positioned in said interior region and having said tab portion thereof extending outwardly through said slot on said dielectric carriage;

said tab portion, outwardly of said slot, extending towards said ground plane adjacent said back side wall of said dielectric carriage;

said tab portion of said conductive strip being connected to said ground plane to form a shorted internal parasitic element to said radiating element.

2. The PIFA of claim 1 wherein said tab portion of said conductive strip is positioned flush with said back side wall of said dielectric carriage.

3. The PIFA of claim 1 wherein said feed tab is positioned flush with said front side wall of said dielectric carriage.

4. The PIFA of claim 1 wherein said feed tab has a lower end positioned in a spaced-apart relationship with said ground plane.

5. The PIFA of claim 4 wherein a through hole is formed in said ground plane below said lower end of said feed tab and wherein a RF cable extends through said through hole for connection with said feed tab.

6. The PIFA of claim 1 wherein the portion of said conductive strip which is positioned within said internal region of said dielectric carriage is spaced from said ground plane and said radiating element.

7. The PIFA of claim 1 wherein the portion of said conductive strip which is positioned within said internal region of said dielectric carriage is generally L-shaped.

8. The PIFA of claim 1 wherein said radiating element includes:

a horizontally disposed segment between said left edge and said right edge of said radiating element;

a first vertically disposed segment on said left edge of said radiating element and being integrally formed therewith;

said first vertically disposed segment of said radiating element being flush with said left side wall of said dielectric carriage;

a second vertically disposed segment on said right edge of said radiating element and being integrally formed therewith;

said second vertically disposed segment of said radiating element being flush with said right side wall of said dielectric carriage.

9. The PIFA of claim 8 wherein said first vertically disposed segment functions as a first capacitive loading plate of said radiating element.

10. The PIFA of claim 9 wherein said second vertically disposed segment functions as a second capacitive loading plate of said radiating element.

11. The PIFA of claim 8 wherein said horizontally disposed segment of said radiating element has a first reactive loading linear slot formed therein.

12. The PIFA of claim 11 wherein said first reactive loading linear slot is positioned between said shorting strip and said left edge of said radiating element.

13. The PIFA of claim 12 wherein said first reactive loading linear slot has an open end at said front edge of said radiating element.

14. The PIFA of claim 13 wherein said first reactive loading linear slot has an axis which is parallel to the major axis of said ground plane.

15. The PIFA of claim 11 wherein said horizontally disposed segment of said radiating element has a second reactive linear loading slot formed therein.

16. The PIFA of claim 15 wherein said second reactive loading linear slot is positioned between said feed tab and said right edge of said radiating element.

17. The PIFA of claim 16 wherein said second reactive loading linear slot has an open end which is positioned at said back edge of said radiating element.

18. The PIFA of claim 17 wherein said second reactive loading linear slot has an axis which is parallel to the major axis of said ground plane.

19. The PIFA of claim 14 wherein said horizontally disposed segment of said radiating element has a second reactive linear loading slot formed therein.

20. The PIFA of claim 19 wherein said second reactive loading linear slot is positioned between said feed tab and said right edge of said radiating element.

21. The PIFA of claim 20 wherein said second reactive loading linear slot has an open end which is positioned at said back edge of said radiating element.

22. The PIFA of claim 21 wherein said second reactive loading linear slot has an axis which is parallel to the major axis of said ground plane.

23. The PIFA of claim 22 wherein a first conductive strip stub extends downwardly from said surface of said radiating element at said front edge thereof.

24. The PIFA of claim 23 wherein said first conductive stub extends vertically downwardly from said top surface of said radiating element closely adjacent said front side wall of said dielectric carriage.

25. The PIFA of claim 24 wherein said first conductive stub is flush with said front side wall of said dielectric carriage.

26. The PIFA of claim 25 wherein said first conductive stub functions as a matching stub for said radiating element.

27. The PIFA of claim 8 wherein said horizontally disposed segment of said radiating element has a first reactive L-shaped slot formed therein.

28. The PIFA of claim 27 wherein said first reactive L-shaped loading slot is positioned between said shorting strip and said left edge of said radiating element.

29. The PIFA of claim 28 wherein said first reactive L-shaped loading slot has an open end which is positioned at said front edge of said radiating element.

30. The PIFA of claim 29 wherein a second conductive stub extends from said top surface of said radiating element.

31. The PIFA of claim 30 wherein said second conductive stub is positioned closely adjacent said back side wall of said dielectric carriage.

32. The PIFA of claim 31 wherein said second conductive stub functions as a second matching stub for said radiating element.

33. The PIFA of claim 32 wherein a third conductive stub extends from said top surface of said radiating element.

34. The PIFA of claim 33 wherein said third conductive stub is closely positioned adjacent said front side wall of said dielectric carriage.

35. The PIFA of claim 34 wherein said third conductive stub functions as a third matching stub for said radiating element.

* * * * *